United States Patent [19]

Brown

[11] Patent Number: 4,637,192

[45] Date of Patent: Jan. 20, 1987

[54] TELESCOPING SUPPORT STRUCTURE

[76] Inventor: Wendell E. Brown, 255 E. 100 South, St. George, Utah 84770

[21] Appl. No.: 747,417

[22] Filed: Jun. 21, 1985

[51] Int. Cl.[4] ..... E04H 12/18

[52] U.S. Cl. ..... 52/632; 52/111; 52/646

[58] Field of Search ..... 52/660, 646, 645, 108, 52/109–111, 632; 248/131

[56] References Cited

U.S. PATENT DOCUMENTS

| | | | |
|---|---|---|---|
| 999,126 | 7/1911 | Sistermann | 52/111 X |
| 1,162,230 | 11/1915 | Foster | 40/486 |
| 1,974,430 | 9/1934 | McKaig | 52/646 |
| 3,435,570 | 4/1969 | Berry | 52/111 X |
| 3,486,279 | 12/1969 | Webb | 52/108 |
| 3,672,104 | 6/1972 | Luckey | 52/646 X |
| 4,524,552 | 6/1985 | Hujsak | 52/645 X |
| 4,532,742 | 8/1985 | Miura | 52/646 X |

FOREIGN PATENT DOCUMENTS

| | | | |
|---|---|---|---|
| 63680 | 9/1913 | Austria | 52/648 |
| 1126633 | 11/1956 | France | 52/109 |
| 586246 | 12/1977 | U.S.S.R. | 52/646 |
| 817184 | 3/1981 | U.S.S.R. | 52/660 |

*Primary Examiner*—J. Karl Bell

*Attorney, Agent, or Firm*—M. Reid Russell

[57] ABSTRACT

A support structure having any number of sides from three to round that includes a lattice structure formed from a flat plate assemblage of components preferably constructed by appropriately cutting slots at intervals in a flat plate so as to form corner and intermediate gusset plates with connected braces, which braces are then each preferably bent along their longitudinally axis into angle braces, the groups of corner and intermediate gusset plates and braces making up sections or tiers of the lattice structure, the tiers nesting alongside on another, such that, when the structure is erected by lifting or elevating the center thereof, the angle braces bent at their joints with the gusset plates telescoping the assemblage into a three dimensional longitudinally tapered structure. The structure is then supported at corners of each tier between vertical legs that connect at intervals to the corner gusset plates of each tier of the tapered structure. Alternatively, the joints between the gusset plates and braces can be upset for a permanent structure or can be hinge couplings where the structure is intended to be later collapsed back to its original flat state for movement and subsequent reassembly.

Additionally, a practice of the present invention can include forming a truss lattice structure by also slotting a rectangular flat plate to form interconnected gusset plates and braces, which braces are then cold formed into angle braces, and the truss lattice structure is erected by pulling apart the opposite rectangular plate ends, the braces bending at their upset joints to the gusset plates, with supports then secured at intervals to outside or edge gusset plates to form a truss.

55 Claims, 12 Drawing Figures

TELESCOPING SUPPORT STRUCTURE

BACKGROUND OF THE INVENTION

1. Field of the Invention

This invention relates to a structural fabrication arrangement for forming metal web towers and the like, where the structure is fabricated in a collapsed state in a shop setting and moved to a site for erection.

2. Prior Art

Numerous prefabricated tower configurations are currently available and restructuring and redesign is occurring in this and related areas for fabricating, in a factory setting, lattice towers and like structures for movement to a job site in a demounted state. Such structures, like the present invention, may include interconnected steel plates and braces for supporting and transferring loads. Support structures, such as electrical transmission towers, because of their size and bulk, have necessitated that they be assembled either from individual components or from prefabricated sections at a site for lifting into place as with a crane, or in recent times, a helicopter. Where parts or sections of such towers have been prefabricated for connection together at a site, the assembly of such a tower has still consumed a great amount of time and labor. Also, of course, handling of prefabricated tower sections has been difficult and expensive, particularly considering the areas where such towers are commonly installed. Additionally, as such towers must be individually erected by a crew bolting together the various components or component assemblies, such bolting process has required both a large amount of time to complete, and has generally required that each individual junction thereafter be weather sealed to avoid tower deterioration.

Distinct from such earlier tower structures and their assembly processes for constructing electrical transmission towers, and the like, the present invention provides for fabrication of a tower in a flat plate state, which flat plate can be easily moved to an erection site. Thereat, it is erected by maintaining the base corners and lifting vertically at a center portion thereof to telescope the tower lattice frame in sections or tiers therefrom, forming a three dimensionally, longitudinally tapered structure. The structure is thereafter fixed at its base corners and continuous corner members are connected to each corner plate of each tier as by bolting or welding that corner thereto. Additionally, unique to the present invention, the components that make up the tower structure are easily assembled in a factory setting in a flat plate configuration, that configuration facilitating painting, dipping, or applying a like covering to the plate components for corrosion protection.

The prior art contains a number of examples of structures that are fabricated to be collapsible for erection at a site. Some examples of such arrangements are shown in patents by Lyons, U.S. Pat. No. 3,751,863; Webb, U.S. Pat. No. 3,486,279; Lotto, et al., U.S. Pat. No. 4,017,932 and Bain, U.S. Pat. No. 4,089,147, all of which show tower type structures formed to be erected at a site. These structures, however, do not involve the flat plate nesting assembly of individual components of the tower lattice structure of the present invention nor are the components functionally similar. Other modular construction arrangements that involve foldable, collapsible, self-supporting structures, other than towers, are shown in patents by Schmidt et al., U.S. Pat. No. 3,557,500; Kelly et al., U.S. Pat. No. 3,888,056; Zeigler, U.S. Pat. No. 3,968,808; and Bliss, U.S. Pat. No. 4,243,284. These structures, while they may be collapsible in that they fold accordian style, are not assembled into or from a flat plate structure as is the present invention, nor are the components thereof arranged like nor do they function like those of the present invention.

Additional to the modular towers and support structures cited above, the prior art includes a number of examples of collapsing tower arrangements that include pivoting arms arranged in scissoring configuration. Such structures, however, generally suffer from the same problem of other collapsible assemblies in that the members collapse one upon another, accordian style, forming a stack of pivotally linked sides. Examples of this type of scissoring structure are shown in patents by Audet, U.S. Pat. No. 1,114,718; Berry, U.S. Pat. No. 3,435,570; and Hardin, U.S. Pat. No. 4,126,974. Somewhat different from these scissoring tower patents, however, is a structure shown in a patent by Luckey, U.S. Pat. No. 3,672,104. The Luckey patent while it shows scissoring links, provides for pivotally coupling the links of each tier side such that they are joined in crossover configuration with the sets of links forming each tier to nest alongside one another, successively inwardly, towards the structure center. This nesting configuration is not, however, flat as is taught by the present invention, as its height will be the width of two links, and, of course, the components thereof are different from those of the present invention, as is the way the structure is fabricated from what is taught by the present invention.

Additionally, a novelty patent by Foster, U.S. Pat. No. 1,162,230 while it shows a paper cut out that is somewhat similar in principal to the present invention, is distinct therefrom in that it involves a paper spring structure that is formed by cutting arcs at spaced distances from the center of a sheet of paper. This Foster patent does not teach forming a tower or support structure, and therefore is, of course, in an entirely different and unrelated area of art than is the present invention.

SUMMARY OF THE INVENTION

It is a principal object of the present invention to provide a telescoping support structure and process for its manufacture where a lattice tower or other support structure is fabricated as an assemblage of interconnected gusset plates and braces that are either formed by appropriately slotting a metal plate or from individual components that are connected together, the assemblage in a flat state for movement to a job site for erection thereat.

Another object of the present invention is to provide a process for forming an upstanding support structure from a flat plate assemblage of components.

It is another object of the present invention to provide for forming the flat plate assemblage of the components of the structure by cutting slots through a flat metal plate so as to form interconnected gusset plates and braces, which flat plate should have dimensions such that when the components are telescoped apart a support structure of a desired height will be formed.

It is another object of the present invention to form the interconnected gusset plates and braces such that the joints thereof are upset to bend appropriately when a separating force is applied thereto to pull the flat plate into a tiered lattice structure.

It is another object of the present invention to provide for constructing a support structure of the like from a flat plate that has been slotted to form an assemblage of gusset plates and connected braces as the components of the lattice structure of the support structure, the braces to be additionally cold rolled to bend longitudinally forming angled braces where the legs formed on each side of that longitudinal axis are at approximately ninety degrees (90°) to one another.

Still another object of the present invention is to provide for forming a flat plate assemblage of individual gusset plates and connected braces of a lattice structure of a support structure that can be conveniently treated in a factory setting against rust as by dipping, painting, or the like.

Still another object of the present invention is to provide a support structure that is capable of being collapsed after erection by utilizing hinges at the junctions of the interconnected gusset plates and braces.

Still another object of the present invention is to provide a versatile support structure that includes as its lattice structure an assemblage of braces and gusset plates that are constructed or assembled in a flat plate configuration and form, when the components are telescoped, the support structure lattice structure to have a strength to weight relationship that is comparable to support structures erected from individual components or prefabricated assemblies of components that are connected together at a job site.

In accordance with the above objects, the present invention in a telescoping support structure and a process for its fabrication provides for assembling together components of a lattice structure of the support structure in a flat plate configuration. The components include corner and intermediate gusset plates with braces connected therebetween, the junctions of which braces with the individual gusset plates upset or hinge connected to encourage rotation thereat.

In erecting the lattice structure from the flat plate component assemblage, the plate outer periphery is loosely maintained in place as by attaching short chains or cables between outer corner gusset plates and a base or the ground and lifting the center as with a crane, lifting helicopter, telescoping jack, or the like. A three dimensional, longitudinal tapered structure is thereby formed where the distance between the corner gusset plates is shortened as the braces bend uniformly at their upset joints or hinge couplings to the individual gusset plates. The braces are bent to each extend from an intermediate gusset plate at an angle from the horizontal to a corner gusset plate. After erection, the corner gusset plates on the outer periphery of each tier of the lattice structure are attached at intervals to continuous vertical corner members. The corner members are each preferably single long sections of angle iron and the connection of the corner gusset members is either by bolting or welding them thereto. The support structure that is so formed will have a height or length that is proportioned to the dimensions of the flat plate assemblage of lattice structure components.

The present invention is preferred for constructing a tower lattice structure of three to four sides. Such structure, however, can have any number of sides and can even be round or can be arranged as a truss. In all tower like support structure arrangements, the process for forming of the flat plate of components will be the same, the only variation being in the plate perimeter shape and dimensions. Alternatively, to form a truss lattice structure, a flat rectangular plate of components can be arranged that will telescope into a lattice structure of a truss which lattice structure is then secured, along its parallel top and bottom edges, at edge or side gusset plates, between parallel supports. To erect such truss, one end of the cut flat plate is pulled relative to the other, the respective braces thereby pivoting or rotating at their upset junctions or hinge joints with the gusset plates, forming the truss lattice structure. The erected truss lattice structure includes the side gusset plates that are secured, at intervals, to the parallel supports, and intermediate gusset plates spaced therebetween, with the braces individually extending between the side and intermediate gusset plates at like angles from the vertical.

The flat plate assemblage of brackets and gusset plates of the tower or truss can alternatively also be formed by joining angle braces or the like, appropriately to gusset plates such that the junctions thereof will bend or rotate appropriately when the structure is telescoped apart. For the tower, the erected lattice structure will consist of tiers stacked one on top of the other, each tier side consisting of adjacent corner gusset plates with an intermediate gusset plate therebetween and with braces angled from the horizontal connected at their ends to extend therebetween.

The present invention is preferably practiced by cutting keyhole type slots through a flat metal plate where the ends of each slot are somewhat enlarged as by drilling or burning therethrough with a drill bit or kerf having a slightly greater diameter than the slot width thus eliminating a stress riser. The slots are cut through the flat metal plate at intervals to form the interconnected gusset plates and braces, the cuts made to leave a plate at the center that has the same number of sides as does the support structure. Each tier is formed by pairs of adjacent corner gusset plates with a single intermediate gusset plate therebetween whereto ends of braces are connected, the braces extending between the adjacent corner and intermediate gusset plates. The sides of each tier will be equadistant from the flat plate center. The formed gusset plates and braces will thereby nest together to provide for bending at the junctions between the braces and gusset plates. The joints are preferably upset such that when a telescoping force is applied to the assemblage the individual braces will bend at their junctions to each gusset plate. Alternatively, the brace to gusset plate junction can be a hinge coupling. Additionally, in the fabrication process, the braces are each preferably reformed by a cold application of a bending force along their longitudinal axis, the brace thereby bent into an angled brace having two equal longitudinal sides that are at approximately right angles to one another. The flat plate assemblage is readily movable and can be rust protected as by painting, dipping, or the like, prior to moving it to a job site.

As set out above, the upset joints can be replaced with hinges. In such arrangement, to provide a collapsible support structure, it is preferred to arrange the connections between the vertical corner members to each corner gusset plate to be releasable. Such connection arrangement is preferably a bolt coupling of the corner gusset plate to a support plate that is secured across the corner member legs. So arranged, the support structure can be collapsed back to its original flat plate configuration for movement, repair, transport or the like. Also, as set out above, within he scope of this disclosure, the support structure can be a truss. In such truss embodiment the component assemblage of the truss lattice structure is also formed by appropriately cutting slots through a flat metal plate that is preferably rectangular. The truss lattice is then erected by pulling apart the plate ends, the lattice structure braces bending between side and intermediate gusset plates, whereafter the truss lattice side gusset plates are secured to upper and lower plates or flanges.

While the above disclosure for a tower is essentially directed to securing the flat plate corners and lifting the flat plate assemblage center to erect the structure, it should be apparent that the structure can begin in a horizontal attitude with either the center or perimeter thereof anchored or pulled, or both center and perimeter can be simultaneously pulled apart to telescope the structure.

These and other objects and features of the present invention shall become more fully apparent from the following detailed description and dependant claims.

DESCRIPTION OF THE DRAWINGS

In the drawings that illustrate that which is presently regarded as the best mode for carrying out the invention.

DETAILED DESCRIPTION

Figure 1:
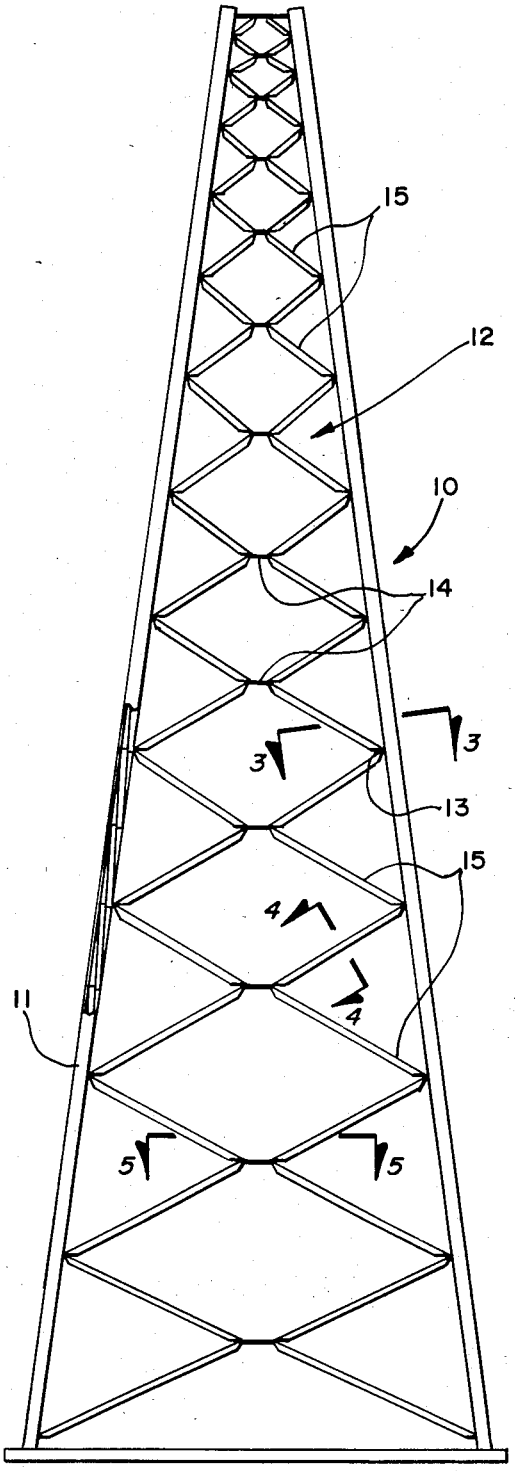
FIG. 1, is a side elevational view of a four sided support tower of the present invention shown in its erected state.
Figure 6:
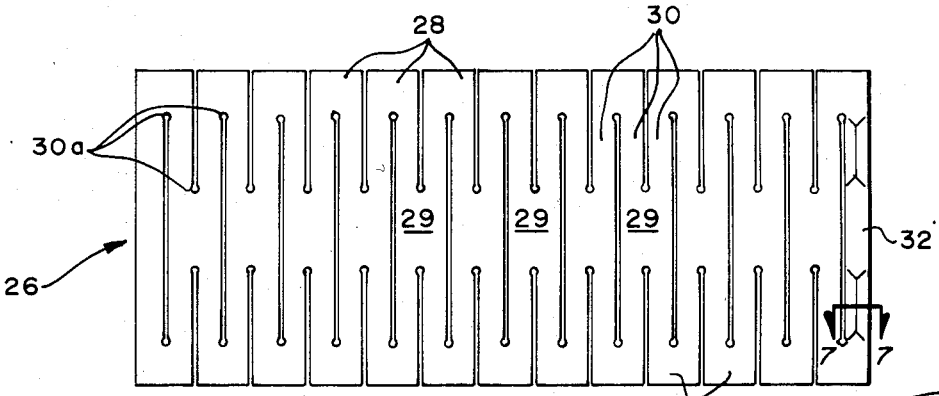
FIG. 6, is a side elevation view of a lattice of a truss embodiment of the present invention showing the lattice components formed in a rectangular flat plate as by appropriately cutting slots through that plate.
Figure 7:
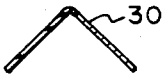
FIG. 7, is a sectional view taken along the line 7—7 of FIG. 6, showing one of the braces of the lattice of FIG. 6 after it has been cold formed into an angle brace.
Figure 6A:
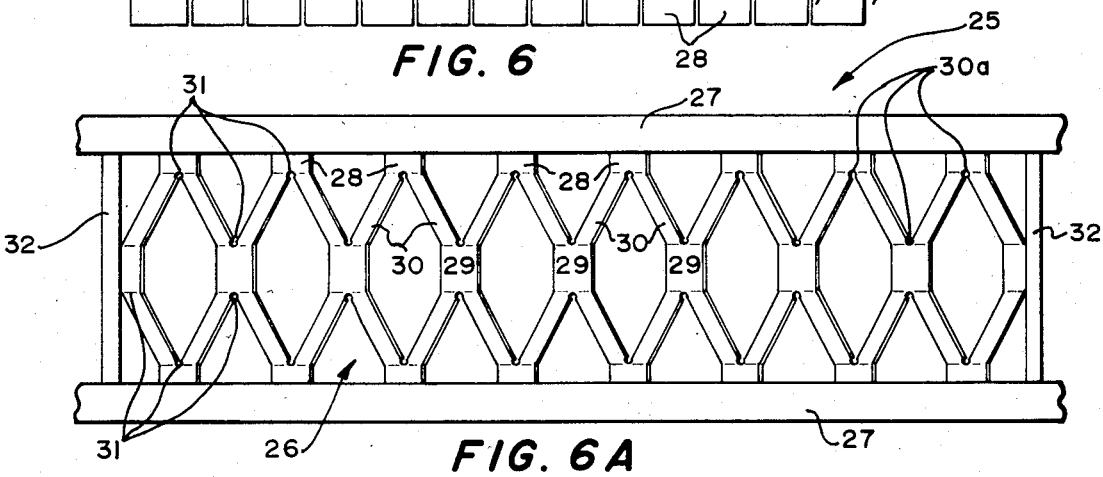
FIG. 6A, is a side elevation view of the lattice portion of the truss of FIG. 6 after the ends thereof have been pulled apart so as to telescope the structure, with parallel top and bottom support members or flanges shown secured to side or edge gusset plates.

FIG. 1 shows a side elevation view of a tower 10 that is shown to be constructed of interconnected members, the tower having four sides and includes corner members 11 that are secured at the structure corners. The corner members are connected at intervals to a tower lattice structure 12, hereinafter referred to as lattice structure. Tower 10 is shown to have a decreasing cross section tapering from its base to a flat top plate 18 forming an elongate pyramid. While a four sided tower is shown in FIG. 1, it should be understood that the present invention can be practiced to form longitudinally tapered towers having any number of sides from three to a full circle within the scope of this disclosure. Additionally, as shown in the embodiment of FIGS. 6, 6A and 7, that will be discussed later herein, the invention can also be applied to fabrication of a truss.

FIG. 1 shows the tower 10, the tower lattice structure 12 fully extended with the corner members 11 installed thereto. FIG. 2 shows the tower lattice structure 12 as a flat plate in its assembled collapsed state, in which state it can be easily treated, as necessary, against rust and can be easily handled and moved to an erection site. The flat plate assemblage of FIG. 2 is preferably formed by appropriately cutting stress relieving keyhole type slots in a flat metal plate, as illustrated in FIG. 2, the flat metal plate is cut to form essentially square flat outside or corner gusset plates 13 and intermediate gusset plates 14, which gusset plates are with braces 15 formed to connect between the respsective corner and intermediate gusset plates.

The lattice structure 12 components are shown in FIG. 2 in nested relationship. Shown therein, the corner gusset plates 13 lie side by side along diagonal lines between the plate corners, with intermediate gusset plates 14 spaced apart therefrom, side by side along vertical and horizontal lines, that are at normal or right angles to one another, through the plate center. Braces 15 are connected between the corner and intermediate gusset plates, one brace end connected to a corner gusset plate with the other brace end connected to an intermediate gusset plate. The lattice structure is made up of tiers stacked one on top of another, tapering from base to apex. Each tier consists of a group of two adjacent corner gusset plates per corner with intermediate gusset plates therebetween that are linked by braces that form a side of the tier. Successive tiers are at lessor radial distances from the plate outer perimeter to its center. So arranged, the tiers when in a flat plate configuration, will nest alongside one another with each corner gusset plate 13 being a component of an adjacent tier. The lattice structure assemblage of components or elements is preferably formed by appropriately cutting slots in the flat metal as shown in FIG. 2, with the formed braces 15 then each subjected to bending along their longitudinal axis by a cold forming application of bending forces. A brace having legs or sides that are essentially a ninety degree (90°) angle to one another is thereby formed as shown best in the sectional view of FIG. 4. Also, in that cold forming process, each junction or joint of a brace 15 to a corner or intermediate gusset plate 13 and 14 side is preferably upset, as illustrated by line 16 in FIGS. 3 and 5, to encourage bending thereat when the tiers are sequentially telescoped outwardly from the flat plate center. This telescoping is illustrated in FIG. 2A, as a partial erection the lattice structure to a full erection shown in FIG. 2B. Additionally, the slots forming the components are drilled at their ends, shown at 15*a*, to have a slightly greater diameter than the slot width to stabilize that slot end eliminating crack or tear propogations thereat when the braces are bent, as discussed below.

The lattice structure 12, in its flat plate configuration, shown in FIG. 2, can be easily transported to an erection site by conventional truck, or the like. Preferably to erect the lattice structure, the flat plate outer corners are secured to the ground 17 by a connection of an end of a chain or cable 17*a* that connects on its opposite end to an outermost corner gusset plate 13, and providing a lifting force applied to the center thereof as with a crane, lifting helicopter, or jack arrangement, not shown. In such erection, depending upon how far the lattice structure sections are pulled apart, the flat plate corners will tend to draw together, the chain or cable allowing for the ends to move together while securing the flat plate to a base or to the ground. So arranged, the outside or perimeter dimensions of the flat plate will relate proportionally to the finished erected structure height or length, taking into account the shortening of the separation distance of the corners.

Figure 2B:
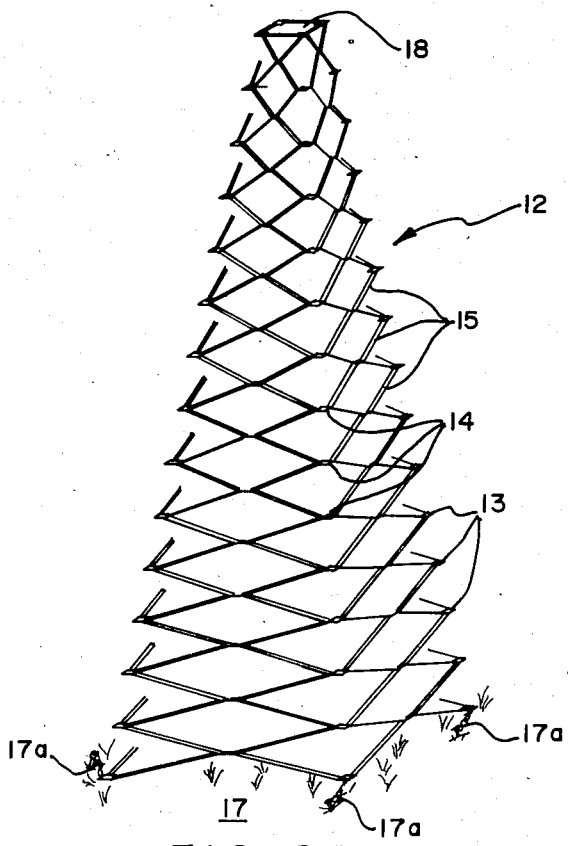
FIG. 2B, is a view like that of FIG. 2A, except it shows the lattice structure telescoped prior to installation of vertical corner members at the corners thereof.
Figure 2A:
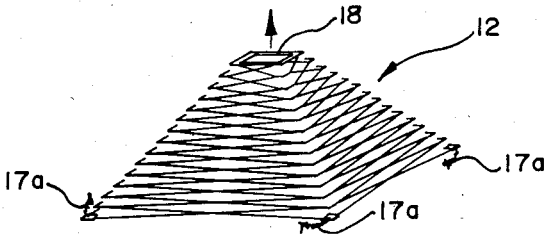
FIG. 2A, is a view like that of FIG. 2 except that a force illustrated by an arrow is shown applied to the center portion of that flat plate showing the lattice components telescoping apart.
Figure 2:
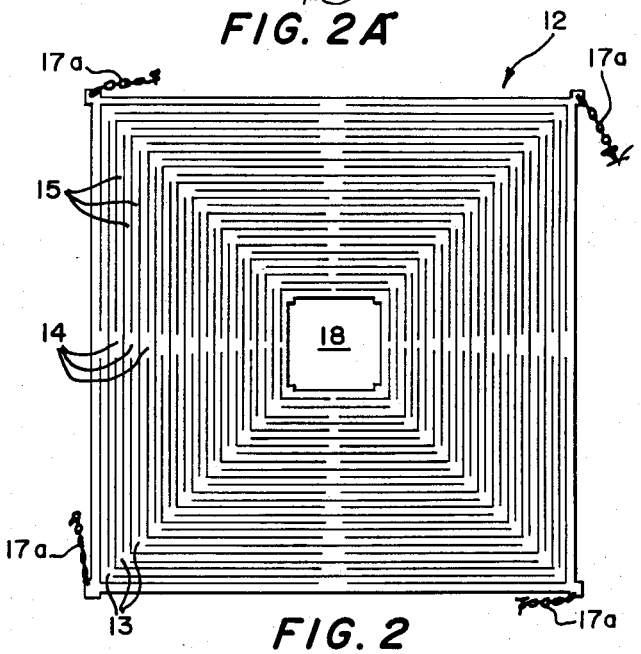
FIG. 2, is a top plan view of the lattice structure of the tower of FIG. 1 in its flat plate configuration prior to its erection.

To assemble the lattice structure 12, as illustrated in FIGS. 2A and 2B, the flat plate corners of what will be the bottom or lower tier corner gusset plates 13 are connected to the ground 17 to a base by the chains or cables 17*a*, or are otherwise anchored, and a lifting force, illustrated as an arrow in FIG. 2A, is applied at the flat top plate 18. The lattice structure components are thereby telescoped outwardly. In the preferred configuration, shown in FIG. 3, the corner gusset plates 13 each have pairs of braces 15 connected side by side to adjacent gusset plate sides, and each intermediate gusset plate 14 has pairs of braces 15 connected side by side to opposite gusset plate sides. The braces 15 each extend between and are connected at their opposite ends, respectively, to a corner gusset plate and to an intermediate gusset plate. The individual braces are preferably centrally longitudinally bent into equal legs that are at approximately ninety degrees (90°) to one another and each pair of braces are arranged to bend individually oppositely to one another. In the tower erection process, as illustrated in FIGS. 2A and 2B, each brace in each pair of braces bends oppositely to the other from the horizontal. This bending of each brace junction corner gusset plate and intermediate gusset plate continues until the braces that are connected to opposite sides of the same intermediate gusset plate that are bent oppositely to the horizontal, will, as shown in FIG. 1, essentially align to form approximately a straight segment across a tower tier side descending or ascending from one tier corner gusset plate 13 to another. Thereafter a corner member 11 is secured to the aligned corner gusset plates stabilizing the structure. The lattice structure 12 and connected corner member 11 thereby form the tower 10. So arranged, horizontal and vertical forces applied to that tower side will be transmitted through the lattice to the tower corner gusset plates and therefrom into the corner members 11 and to the base corners.

In the described telescopeing process, each upset joint 16, as detailed above, will experience a bending and any protective layer or coating that has been applied thereto, such as by dipping or painting, may be broken free. Such will thereafter necessitate some repair of those joints after the tower is erected. Once the tower is erected, as set out above and as illustrated by the drawing of FIG. 2B, it is maintained in that erected state by the installation of the corner members 11 thereto. In the embodiment of FIGS. 1 and 3, the corner member 11 receives, at spaced intervals, the corner gusset plates attached thereto, as by welding along bead 19, to form a permanent connection. So arranged, the tower 10 is permanently erected and can thereafter receive, as required, appropriate components or other structural arrangements. Such other structural arrangements, as say when a tower 10 is for use as an electrical power transmission line tower, can consist of a pair of goat's horns, or the like, which could also employ technology learned in this disclosure, that extend from opposite tower sides, near the tower apex, and wherefrom insulators, or the like, not shown, can be hung.

Figure 3A:
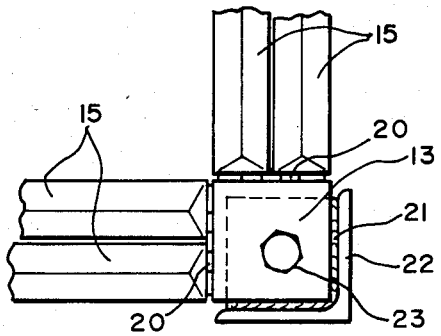
FIG. 3A, is a sectional view like that of FIG. 3 except that it shows a separate support plate welded across the inside legs of a corner member that has a hole formed centrally therethrough, which hole will align with a hole formed in the corner gusset plate to receive a connector therethrough, with the junction between the corner gusset plate to the braces shown to be a hinge coupling.
Figure 3:
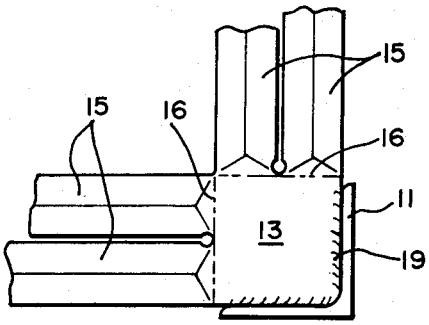
FIG. 3, shows a sectional view taken along the line 3—3 of FIG. 1, showing a corner gusset plate welded across the inside legs of a corner member.
Figure 5:
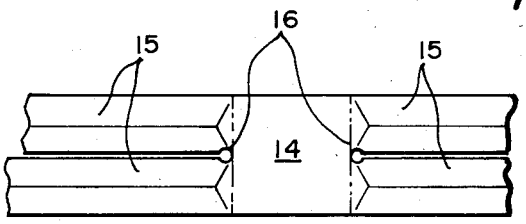
FIG. 5, is a sectional view taken along the line 5—5 of FIG. 1 showing an intermediate gusset plate with braces joined thereto at the opposite plate ends.
Figure 5A:
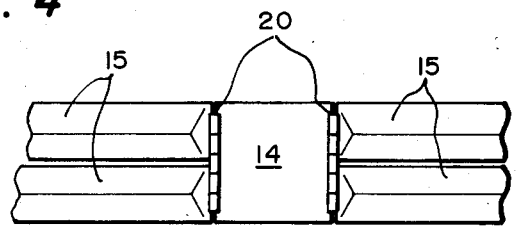
FIG. 5A, is a sectional view like that of FIG. 5 except that it shows the joints between the intermediate gusset plate ends and the ends of the braces as being hinge couplings.

Alternatively, to provide a lattice support 12 that can be easily disassembled or collapsed back to its flat plate state, the embodiments of FIGS. 3A and 5A can be employed. In these embodiments hinges 20 replace the upset joints 16 of FIGS. 3 and 5, the hinges to bend, as has been described for the upset joints to form the tower 10 lattice structure 12 of FIG. 2B. The braces 15 and their hinge couplings to the gusset plates shown in FIGS. 3A and 5A can therefore be freely rotated, respectively, between erected and collapsed states. In this embodiment, to accommodate the tower disassembly or collapse, the corner members 11 will preferably include toe plates 21 that, as shown in FIG. 3A, are preferably secured by welding, to extend between and across the inner surfaces of the corner members 11 sides or legs. The toe plates 21 form platforms or rests whereon corner gusset plates 13 can be set. In the configuration of FIG. 3A, a hole 23 is shown formed through both the corner gusset plate 13 and toe plate 21 to receive a bolt with a nut turned thereon, or like fastener, not shown, for securing the corner gusset and toe plates together. This arrangement allows the corner gusset plate and support member to be later separated for collapsing the lattice structure 12, as discussed. Of course, as cracking or tearing forces will not be present at the hinge couplings, it may not be necessary in this embodiment to drill or form holes through the slot ends.

Unique to the present invention, as has been detailed above, is the forming of the lattice structure 12 of a support structure as an assemblage of corner and intermediate gusset plates with braces connected therebetween. This assemblage of components will nest in a flat plate state for movement to and erection at a site. The assemblage can involve either upset joints or hinge couplings between the braces and gusset plates, which junction selection is dependent upon whether the structure is to be permanently erected or is intended to be capable of being later collapsed back to its flat plate state for transport.

The invention is not, as described above, limited to forming the assemblage of components by cutting and cold rolling a single plate of metal. Alternatively, within the scope of this disclosure, the respective corner and intermediate gusset plates and braces connected thereto can be assembled from individual components that are then connected together, as described, to form the flat plate configuration shown in FIG. 2. Such construction of the lattice structure from individual components can also involve upsetting the joints formed between the gusset plates and braces, or can involve linking the components with hinge joints, as discussed above. In either arrangement, the components making up each tier will lie or nest alongside one another to form the flat plate. In which flat plate, the components making up each tier are spaced at successively shorter radial distances from the plate center, with the flat top plate 18 at the plate center to form the apex of the lattice structure 12.

Figure 4:
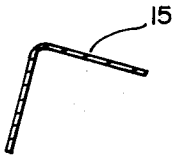
FIG. 4, is a cross sectional view of a bracket taken along the line 4—4 of FIG. 1 showing that it has been cold formed into an angle brace.

Additionally, as shown in FIG. 6A, the present invention can be applied to fabrication of a truss 25 that includes a truss lattice 26 connected between upper and lower horizontal supports 27. The truss lattice 26 is shown in a flat plate state in FIG. 6. Therein, the truss lattice is shown as being preferably formed by slotting vertically at intervals a flat rectangular plate to form, along the respective top and bottom edges, side or edge gusset plate 28 that are essentially square flat plates. Centrally between the edge gusset plates are formed intermediate gusset plates 29 that are essentially flat rectangular plates. The respective gusset plates, in turn, have the ends of braces 30 connected therebetween, one end to an edge gusset plate 28 and the other brace end connected to an intermediate gusset plate 29. Braces 30, as illustrated in FIG. 7, like the braces 15 of FIG. 4, are each preferably subjected to cold rolling to bend the brace along its longitudinal axis so as to form equal longitudinal sides, which sides are at ninety degree (90°) angles to one another, forming thereby an angle brace. In the process of forming the truss lattice assemblage of components, the junctions between the braces 30 and the gusset plates 28 and 29 are preferably upset at 31 to encourage bending thereat as the assemblage is telescoped apart into the configuration shown in FIG. 6A. Also, shown best in FIG. 6, the ends of the slots, are preferably drilled or otherwise holed at 30*a*, to form keyhole type slots, the holes to have a slightly greater diameter than the slot width and are to curtail the slot from further tearing or cracking when a bending stress is applied to said braces.

To form the truss shown in FIG. 6A, opposing forces are applied at lattice ends 32, to spread or pull apart the two ends causing also thereby some shortening of the distance between edge gusset plates 28. The truss lattice thereby decreases in width from the flat plate configuration of FIG. 6 to the telescoped structure of FIG. 6A. In this telescoping process, sections of tiers of the truss lattice structure are formed that include adjacent edge gusset plates 28 with a single intermediate gusset plate 29 therebetween. The braces 30 are each connected at its ends, respectively, to an edge gusset plate 28 and to an intermediate gusset plate 29. So arranged, as with the corner gusset plates 13, each edge gusset plate 28 is shared by adjacent sections or tiers, the braces at their upset junctions to each gusset plate 28 or 29 bent away from one another at angles to the vertical, bending to the attitude shown in the view of Fig. 6A. Additional to bending of braces, the respective gusset plates themselves will be rotated or canted, which angle of rotation will be relative to a plane that is at a normal angle across the gusset plate, and the amount of that rotation is dependant upon the extent wherein the truss lattice is telescoped. Thereafter, as shown in FIG. 6, the truss lattice is attached to the upper and lower supports 27, which supports can be angle members, plate stock, or the like. The individual edge gusset plates 28 are each secured, preferably by welding, or the like, to the supports. Similar to the braces 15 of the tower of FIG. 1, pairs of braces 30 are connected to, respectively, an edge gusset plate with opposite brace ends connected to adjacent or side by side intermediate gusset plates. The braces 30 are bent oppositely to the vertical, each extending between an edge gusset plate and an intermediate gusset plate 29, the braces intersecting opposite sides of the intermediate gusset plate bent oppositely such that two braces will form approximately a straight line across that intermediate gusset plate for transmitting or transferring forces therethrough and to the edge gusset plates 28, which forces are then transferred into the upper and lower supports 27, as illustrated in FIG. 6A.

As with the described tower embodiment of FIGS. 1 and 2, the assemblage of components of FIGS. 6 and 6A can be formed other than by cutting slots in a flat rectangular plate. For example, the lattice structure of FIG. 6 can be formed by connecting individual angle braces and gusset plates together into the rectangular flat plate configuration. Also, this arrangement can be made to be collapsible by substituting hinge joints, like those shown in FIG. 3A and 5A, for the upset joints 31 formed between the braces and gusset plates of FIG. 6.

In practice, to form the tower 10 or truss 25, a sheet of steel of A588 grade B or equal is preferably used as the flat plate wherein the components are formed. Using this material, it is not necessary to galvanize or paint such structure as the material itself is weather proof. Furthermore, tensiles and yields of A588 Grade B exceed strengths of mild steel by up to 30% thereby reducing overall design weight, and reducing shipping costs significantly.

Possible uses for this lattice structure arrangement include, but are not limited to: towers for power transmission, radio signal, microwave, windmill or forest fire protection; numerous marine uses, such as offshore drilling or pier construction; farm structures, such as hoppers and large irrigation assemblies; for heavy construction applications, the erected structure can be used as a substitute for steel rebar lattice layups as for example; for dams, pilings, and the like and, depending on the size or the dimensions of the plate from which the lattice structure is formed, the invention could potentially be used to construct a dwelling, or the like. A futuristic application of the invention could involve its use for space developments as for example a frame work for a space station, as extension arms that extend from a satellite, or the like.

While the invention in forming a support structure from a flat plate assemblage of components and a process for fabricating that flat plate assemblage and its erection into a support structure has been shown and described herein in preferred forms, it should be understood that the invention may be embodied in other specific forms without departing from the spirit or essential characteristics described herein. The present embodiments are, therefore, to be considered in all respects as illustrative, are made by way of example only and variations thereto, within the scope of the disclosure, are possible without departing from the subject matter coming within the scope of the claims, which claims I regard as my invention.

I claim:

1. A support structure including, as a lattice structure, a flat plate assemblage of nested components that include outside and intermediate gusset plates with braces extending therebetween, the braces to bend or rotate at their junctions with the respective gusset plates, when a force is applied to said assemblage to telescope that assemblage apart forming tiers, each tier involving sides where the outside gusset plates are shared between tiers with an intermediate gusset plate arranged therebetween on a bias angle across each tier side, the braces each secured at their ends between on a bias angle across each tier side, the braces each secured at their ends between an outside gusset plate and an intermediate gusset plate; means for telescoping apart the flat plate assemblage of components; means for establishing and maintaining the spacing of the adjacent outside gusset plates providing for the erecting of the assemblage to a predetermined height that includes at least three straight corner members that are bent longitudinally to accommodate individual outside gusset plate edges therebetween; and means for securing each outside gusset plate at a location to a straight corner member to provide said desired outside gusset plate spacing.

2. A support structure as recited in claim 1, wherein the flat plate assemblage of components is formed by appropriately cutting slots in a flat metal plate to form flat outside and intermediate gusset plates with the braces secured therebetween.

3. A support structure as recited in claim 2, further including bending the individual braces along their longitudinal axis to form equal longitudinal sides at approximately a ninety degree (90°) angle to one another.

4. A support structure as recited in claim 2, wherein the junction of each brace leg to a gusset plate is upset.

5. A support structure as recited in claim 3, wherein the brace longitudinal bending is accomplished by a cold forming process.

6. A support structure as recited in claim 2, wherein a hinge means is arranged at each junction of a brace with a gusset plate to provide for rotation of each said brace relative to said gusset plate.

7. A support structure as recited in claim 2, further including covering the flat plate assemblage with a rust resistant coating.

8. A support structure as recited in claim 2, wherein the metal flat plate is a sheet of steel of a 588 grade B or equal.

9. A support structure as recited in claim 1, wherein the flat plate assemblage of components is formed by interconnecting next to one another, in nesting relationship, individual rectangular outside, and intermediate gusset plates by angle braces that are connected therebetween, which braces are individually arranged to bend at their junction with said gusset plates when the telescoping force is applied to the assemblage.

10. A support structure as recited in claim 9, wherein the joints between the braces and gusset plates are upset to bend or rotate thereat when the telescoping force is applied thereto.

11. A support structure as recited in claim 9, wherein the individual brace ends are connected to the respective gusset plates by a hinge means.

12. A support structure as recited in claim 9, further including covering the flat plate assemblage with a rust resistant coating.

13. A support structure as recited in claim 1, wherein the means for maintaining the assemblage in its telescoped state are straight members each arranged to be connected, at intervals, to adjacent and vertically aligned outside gusset plates, each straight member to extend from one end of the lattice support structure to the other.

14. A support structure as recited in claim 1, wherein he support structure is a longitudinally tapered tower having three or more equal sides to a full circle, and the flat plate has the same number of equal sides to round as does the tapered tower.

15. A support structure as recited in claim 14, wherein the flat plate includes, a flat top plate arranged at the center thereof that is connected at its edges to brace ends.

16. A support structure as recited in claim 15, wherein, with the flat plate perimeter is loosely secured to a base or to ground at its corners or at intervals around its perimeter by a tether means to anchor the flat plate while still allowing said plate corners to draw together when the flat top plate receives a force applied thereto to telescope the interconnected components therewith to an extended state.

17. A support structure as recited in claim 16, wherein the means for telescoping is a lifting force applied to elevate the flat top plate relative to the perimeter of the flat plate assemblage.

18. A support structure as recited in claim 1, wherein the straight corner members are angle members bent along their longitudinal axis into equal legs, said legs to receive adjacent edges of outside gusset plates therebetween; and the means for securing each said outside gusset plate across said angle member legs is by welding said outside gusset plate adjacent edges to said legs.

19. A support structure as recited in claim 1, wherein the straight corner members are bent along their longitudinal axis into equal legs, said legs to receive adjacent edges of outside gusset plates therebetween; the means for securing outside gusset plate adjacent edges between the corner member legs is by securing a plate across said legs at normal angles thereto to receive said outside gusset plate thereon; and means for maintaining said outside gusset plate on said plate that spans between said corner member legs.

20. A support structure as recited in claim 19, wherein the plate connected at a normal angle across said corner member legs is secured thereto by welding; and a hole is formed through both the plate and the outside gusset plate to receive a bolt therethrough as the means for maintaining said outside gusset plate on said plate.

21. A support structure as recited in claim 1, wherein the flat plate assemblage is a rectangle having a long length to width relationship to form, when telescoped by moving the respective parallel short ends apart, a truss; and the means for maintaining the assemblage in its telescoped state are paralleled horizontal members that are secured, at intervals, to the outside gusset plates.

22. A support structure as recited in claim 21, further including, straight end pieces formed at the flat plate short ends to span the telescoped truss ends that each receive an oppositely directed force to telescope the assemblage of components.

23. A telescoping lattice structure for a support structure including, forming a flat plate assemblage of nested components that include outside and intermediate gusset plates with braces extending therebetween, the braces to bend or rotate at their junctions with the respective gusset plates, when a force is applied to said assemblage to telescope that assemblage apart forming tiers, each tier involving sides where the outside gusset plates are shared between tiers with an intermediate gusset plate arranged therebetween on a bias angle across each tier section, the braces each secured at their ends between an outside gusset plate and an intermediate gusset plate; and means for maintaining the assemblage in its telescoped state that includes a plurality of straight edge support members to connect at spaced intervals to individual outside gusset plates setting the interval between said outside gusset plates and determining thereby the erected support structure dimensions.

24. A support structure as recited in claim 23, wherein the flat plate assemblage of components is formed by appropriately cutting slots in a flat metal plate to form flat outside and intermediate gusset plates with the braces secured therebetween.

25. A support structure as recited in claim 24, further including bending the individual braces along their longitudinal axis to form equal longitudinal sides at approximately a ninety degree (90°) angle to one another.

26. A support structure as recited in claim 24, wherein the brace longitudinal bending is accomplished by a cold forming process.

27. A support structure as recited in claim 24 wherein the junction of each brace leg to a gusset plate is upset.

28. A support structure as recited in claim 24, wherein a hinge means is arranged at each junction of a brace with a gusset plate to provide for rotation of each said brace relative to said gusset plate.

29. A support structure as recited in claim 24, further including covering the flat plate assemblage with a rust resistant coating.

30. A support structure as recited in claim 24, wherein the metal flat plate is a sheet of steel of a 588 grade B or equal.

31. A support structure as recited in claim 23, wherein the flat plate assemblage of components is formed by connecting, in nesting relationship, adjacent individual outside and intermediate gusset plates to angle braces that are connected therebetween, which braces are individually arranged to bend at their junction with said gusset plates when a telescoping force is applied to the assemblage.

32. A support structure as recited in claim 31, wherein the joints between the braces and gusset plates are upset to bend or rotate thereat when the telescoping force is applied thereto.

33. A support structure as recited in claim 31, wherein the individual brace ends are connected to the respective gusset plates by a hinge means.

34. A support structure as recited in claim 31, further including covering the flat plate assemblage with a rust resistant coating.

35. A process for forming a lattice structure of a support structure including the steps of cutting spaced apart slots through a flat metal plate to form therein an assemblage of nested components that include outside and intermediate gusset plates with braces connected to extend therebetween such that the braces will bend or rotate at their junctions with the respective gusset plates, when a force is applied to said assemblage to telescope that assemblage apart the telescoping components forming tiers, with each tier including sides where the outside gusset plates are shared between tiers with an intermediate gusset plate arranged therebetween and on a bias angle across each tier side, the braces each secured at their ends between an outside gusset plate and an intermediate gusset plate; applying a force to telescope apart the flat plate assemblage of components; and attaching each outside gusset plate at intervals to vertical support members, said interval distances between individual outside gusset plates selected to determine the support structure height.

36. A process as recited in claim 35, further including the steps of bending the individual braces along their longitudinal axis to form equal longitudinal sides at approximately a ninety degree (90°) angle to one another.

37. A process as recited in claim 36, wherein the step of bending the brace along its longitudinal axis is accomplished by a cold forming process.

38. Process as recited in claim 35, further including the step of upsetting the junction between each brace leg to a gusset plate.

39. A process as recited in claim 35, further including the step of installing a hinge at each junction of a brace with a gusset plate.

40. A process as recited in claim 35, further including the step of covering the flat plate assemblage of components with a rust resistant coating.

41. A process as recited in claim 35, wherein the flat metal plate is a sheet of steel of a 588 grade B or equal.

42. A process as recited in claim 35, further including the step of bending the straight members along their longitudinal axis into equal legs to accommodate the edges of outside gusset plates therebetween, and securing at select intervals plates between the straight member legs to support the outside gusset plates positioned thereon.

43. A process for forming a lattice structure of a support structure including a flat plate assemblage of nested components that include outside and intermediate gusset plates with braces extending therebetween, by connecting individual rectangular outside and intermediate gusset plates to angle braces, the braces extending therebetween, which braces are individually arranged to bend at their junction with said gusset plates when a telescoping force is applied to said assemblage to telescope assemblage apart, the telescoping components to form tiers, with each tier including sides where the outside gusset plates are shared between tiers with an intermediate gusset plate arranged therebetween on a bias angle across each tier side, the braces each secured at its ends between an outside gusset plate and an intermediate gusset plate; applying a force to telescope apart the flat plate assemblage of components; and connecting straight members, at select intervals to set the spacing between outside gusset plates establishing the support structure vertical dimension, each straight member to extend from one end of the lattice support structure to the other.

44. A process as recited in claim 43, further including the step of upsetting the joints between the braces and gusset plates such that the braces will bend or rotate thereat when the telescoping force is applied thereto.

45. A process as recited in claim 43, further including the step of connecting the individual brace ends to the respective gusset plates by hinges.

46. A process as recited in claim 43, further including the step of covering the flat plate assemblage of components with a rust resistant coating.

47. A telescoping lattice structure for a support structure formed by cutting appropriately spaced slots through a flat metal plate to form a flat plate assemblage of nested components that include outside and intermediate gusset plates with braces extending therebetween, the braces to bend or rotate at their junctions with the respective gusset plates, when a force is applied to said assemblage to telescope that assemblage apart, which telescoping forms tiers, each tier involving sides where the outside gusset plates are shared between tiers with an intermediate gusset plate arranged therebetween on a bias angle across each tier side, the braces each secured at their ends between an outside gusset plate and an intermediate gusset plate; at least three straight corner members that are bent longitudinally to accommodate individual outside gusset plate edges therebetween; and means for securing each outside gusset plate at a location to a straight corner member to provide a desired outside gusset plate spacing so as to provide a required height of support structure.

48. A support structure as recited in claim 47, wherein the flat plate assemblage of components is formed by appropriately cutting slots in a flat metal plate to form flat rectangular outside and intermediate gusset plates with the braces secured therebetween.

49. A support structure as recited in claim 48, further including bending the individual braces along their longitudinal axis to form equal longitudinal sides at approximately a ninety degree (90°) angle to one another.

50. A support structure as recited in claim 48, wherein the junction of each brace leg to a gusset plate is upset.

51. A support structure as recited in claim 48, wherein the brace longitudinal bending is accomplished by a cold forming process.

52. A support structure as recited in claim 47, wherein a hinge means is arranged at each junction of a brace with a gusset plate to provide for rotation of each said brace relative to said gusset plate.

53. A support structure as recited in claim 48, further including covering the flat plate assemblage with a rust resistant coating.

54. A support structure as recited in claim 48, wherein the metal flat plate is a sheet of steel of a 588 grade B or equal.

55. A support structure as recited in claim 47, wherein the straight corner members are bent along their longitudinal axis into equal legs, said legs to receive adjacent edges of outside gusset plates therebetween; means for securing outside gusset plate edges between the corner member legs that includes securing a plate across said legs to receive means for maintaining said outside gusset plate on said plate.

* * * * *